US010707610B1

(12) United States Patent
Wang

(10) Patent No.: US 10,707,610 B1
(45) Date of Patent: Jul. 7, 2020

(54) ADAPTOR AND CONNECTOR ASSEMBLY

(71) Applicant: Shenzhen tongyinhai precision electronics co. LTD, Shenzhen, Guangdong (CN)

(72) Inventor: Yinyin Wang, Guangdong (CN)

( * ) Notice: Subject to any disclaimer, the term of this patent is extended or adjusted under 35 U.S.C. 154(b) by 0 days.

(21) Appl. No.: 16/535,104

(22) Filed: Aug. 8, 2019

(30) Foreign Application Priority Data

Jan. 17, 2019 (CN) ..... 2019 2 0084677 U

(51) Int. Cl.

| | |
|---|---|
| ***H01R 13/62*** | (2006.01) |
| ***H01R 39/12*** | (2006.01) |
| ***H01R 31/06*** | (2006.01) |
| *H01R 107/00* | (2006.01) |

(52) U.S. Cl.
CPC ..... *H01R 13/6205* (2013.01); *H01R 31/06* (2013.01); *H01R 39/12* (2013.01); *H01R 2107/00* (2013.01)

(58) Field of Classification Search
CPC .... H01R 13/6205; H01R 31/06; H01R 39/12; H01R 2107/00; H01R 24/62; H01R 11/30; H01R 31/065; H01B 2107/00
USPC ..... 439/39
See application file for complete search history.

(56) References Cited

U.S. PATENT DOCUMENTS

| | | | | |
|---|---|---|---|---|
| 7,658,613 | B1 * | 2/2010 | Griffin | H01R 13/6205 439/39 |
| 9,515,420 | B2 * | 12/2016 | Daoura | H01R 13/6205 |
| 9,979,138 | B1 * | 5/2018 | Chen | H01R 13/7137 |
| 9,991,628 | B2 * | 6/2018 | Daoura | H01R 13/6205 |
| 10,069,265 | B2 * | 9/2018 | Wu | H02J 7/00 |
| 10,333,249 | B1 * | 6/2019 | Wang | H01R 13/6205 |
| 2012/0164849 | A1 * | 6/2012 | Lee | H01R 13/6205 439/39 |
| 2014/0162468 | A1 * | 6/2014 | Kim | H01R 13/6205 439/39 |
| 2014/0220793 | A1 * | 8/2014 | Yen | H01R 13/6205 439/39 |
| 2016/0211609 | A1 * | 7/2016 | Sorias | H01R 13/6205 |
| 2018/0331468 | A1 * | 11/2018 | Little | H01R 13/6271 |

* cited by examiner

*Primary Examiner* — Edwin A. Leon
(74) *Attorney, Agent, or Firm* — ZANIP

(57) ABSTRACT

An adaptor includes a male adaptor support; an adaptor plate arranged on the male adaptor support; a conductive ring arranged on the adaptor plate; and an adaptor joint, the adaptor joint and the adaptor plate separately arranged at two ends of the male adaptor support, the conductive ring electrically connected with the adaptor joint.

12 Claims, 9 Drawing Sheets

ADAPTOR AND CONNECTOR ASSEMBLY

CROSS REFERENCE TO RELATED APPLICATION

This application claims the benefit of Chinese Application No 2019200846776, filed on Jan. 17, 2019, entitled "Adaptor And Connector Assembly". Chinese Applications No. 2019200846776 are incorporated by reference herein in its entirety for all purposes.

TECHNICAL FIELD

The present disclosure relates to a connector, a data line and a connector assembly.

BACKGROUND

With the increasing of science and technology, various electronic devices, such as mobile phones, tablets and notebook computers, have entered the daily human life, people can watch movies, play games and the like, by using a mobile phone, and the daily human life has been greatly enriched.

When the battery of the electronic device is exhausted, the electronic device needs to be connected to a power supply through a connector so as to get charged; when a file transmitting is, required between electronic devices, the electronic devices also need to be connected together through the connector.

However, the fixation between a current connector and the electronic device is substantially a fixed connection, the electronic device and the connector cannot rotate relative to each other. The electronic device may rotate during the use process, causing the connector to drive the charging line to get twisted, and the charging line may be twisted to be braided, thus damaging the charging line, and causing poor contact.

SUMMARY

Embodiments of the present disclosure provide an adaptor and a connector assembly convenient to use, in which the charging line is not easy to get damaged.

A first technical solution adopted by the present disclosure is to provide an adaptor which includes:

- a male adaptor support;
- an adaptor plate, which is arranged on the male adaptor support;
- a conductive ring, which is arranged on the adaptor plate; and
- an adaptor joint, the adaptor joint and the adaptor plate are separately arranged at two ends of the male adaptor support, the conductive ring electrically connected with the adaptor joint.

Typically, the adaptor further includes a male-end magnet, and the male-end magnet is arranged on the male adaptor support.

Typically, the male-end magnet is ring-shaped.

Typically, the male adaptor support is provided with a convex column, the adaptor plate is arranged at an end of the convex column, and the male-end magnet is sleeved on the convex column, with an end of the adaptor plate, away from the convex column, protruding out of an end surface of the male-end magnet.

Typically, a groove is formed at the end of the convex column, and the adaptor plate is arranged in the groove.

Typically, one side of the adaptor plate is provided with a sliding chute, wherein the conductive ring is arranged on the inner wall of the sliding chute.

Typically, the adaptor is any one of a micro USB connector, a type-c connector or a lightning connector.

A second technical solution adopted by the present disclosure is to provide a connector assembly, including:

- the adaptor described above: and
- a connector, including a female adaptor support and a conductive element arranged on the female adaptor support, the conductive element provided with a rotary contact portion, and the rotary contact portion protruding out of an end surface of the female adaptor support;
- when the adaptor and the connector are in contact and rotate relative to each other, the rotary contact portion keeping electrically connected with the conducting ring.

Typically, the connector assembly further includes a female-end magnet, and the female-end magnet is provided with a sleeve connection hole, the sleeve connection hole is sleeved on the female adaptor support and forms a positioning cavity, and the adaptor plate is inserted into the positioning cavity to rotatably connect the adaptor with the connector.

Typically, the connector assembly further includes a clamping block, a installation cavity is formed at one end of the female adaptor support, and a through hole formed at the other end of the female adaptor support communicates with the installation cavity; one end of the conductive element is fixed to the clamping block, and the other end of the conductive element penetrates through the installation cavity and penetrates out of the through hole; the clamping block is clamped with the installation cavity to fix the conductive element in the female adaptor support.

Typically, the connector assembly further includes a base, a circuit board and a shell, the female adaptor support is provided with a slot, the circuit board is inserted into the slot and electrically connected with the conductive element; the circuit board, the clamping block and one end of the female adaptor support are integrally formed with the base through injection molding, and the shell is sleeved on the other end of the female adaptor support to surround the female adaptor support and the female-end magnet.

Typically, the connector assembly further includes a wire and a plug, the wire connects the plug with the base, and the plug is electrically connected with the circuit board.

A third technical solution adopted by the present disclosure is to provide a connector assembly includes:

- the adaptor described above: and
- a connector, including a female adaptor support and a conductive element and a shell, wherein the conductive element is arranged on the female adaptor support, and the shell is sleeved on the female adaptor support, the conductive element is provided with a rotary contact portion, and the rotary contact portion protrudes out of an end surface of the female adaptor support; wherein
- the shell and the female adaptor support form an accommodation cavity, the male adaptor support is inserted into the accommodation cavity to electrically connect the conductive ring with the rotary contact portion, to rotatably connect the adaptor with the connector.

The shell and the female adaptor support form an accommodation cavity, the revolution connection support is inserted into the accommodation cavity and enables the conductive ring to be electrically connected with the rotary contact portion, so that the adaptor can be rotationally and electrically connected with the connector.

Typically, the connector assembly further includes a female-end magnet, and the female-end magnet is sleeved on the female adaptor support and is located in the accommodation cavity.

In the light of the above technical solutions, the present disclosure involves following advantages.

The adaptor and the connector assembly are provided with a conductive ring and a conductive element which are rotatably connected, and when the adaptor and the connector rotate relative to each other, the conductive element and the conductive ring can still be electrically connected, thus avoiding poor contact caused by twisting of the wire of the connector during use, achieving a simple structure and convenient use. The conductive element is in surface contact with the conductive ring, the contact area is large, further achieving high connection stability and a good heat dissipation effect.

DETAILED DESCRIPTION

The present disclosure is further described in detail with reference to the accompanying drawings in the following description.

Figure 1:
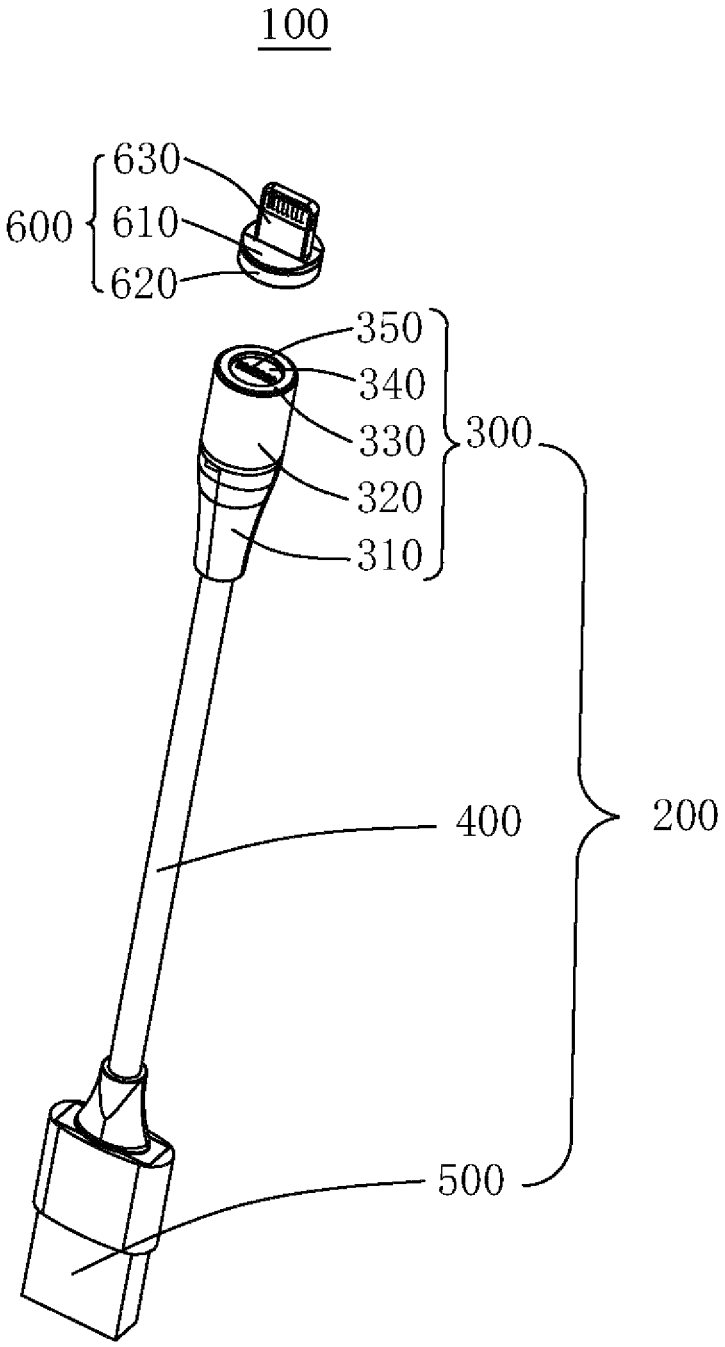
FIG. 1 is a schematic structural diagram of a connector assembly of the present disclosure, the connector assembly including an adaptor and a connector.
Figure 2:
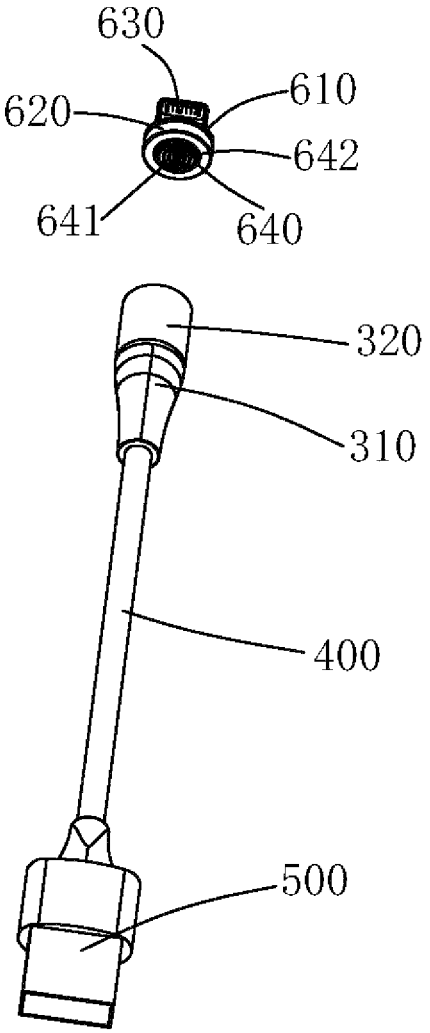
FIG. 2 is a structural schematic diagram of the connector assembly shown in FIG. 1 from another viewing angle.

As shown in FIG. 1 and FIG. 2, a connector assembly 100 includes a connector 200 and an adaptor 600. The connector 200 includes a connecting body 300, a wire 400 and a plug 500, which are connected in sequence. The adaptor 600 can be rotatably connected with the connector 200 through a magnetic attraction structure, so as to realize a quick connection between the adaptor 600 and the connector 200. During use, for example in a driving process, the mobile phone is fixed on a vehicle-mounted mobile phone support, and the adaptor 600 is directly inserted into a charging port of the mobile phone, the position of the adaptor 600 is fixed and will not rotate, when the connector 200 is close to the adaptor 600, due to the magnetic attraction force, the connector 200 can be automatically adsorbed together with the adaptor 600. In this case, since the wire 400 may distort and deform, torsion force is generated, the torsion force may drive the connector 200 to rotate to relieve the torsion force of the wire 400, further to avoid the twisting deformation of the wire 400 in a long-term use process, and the using effect will be better. Optionally, the plug 500 is a USB plug.

Figure 3:
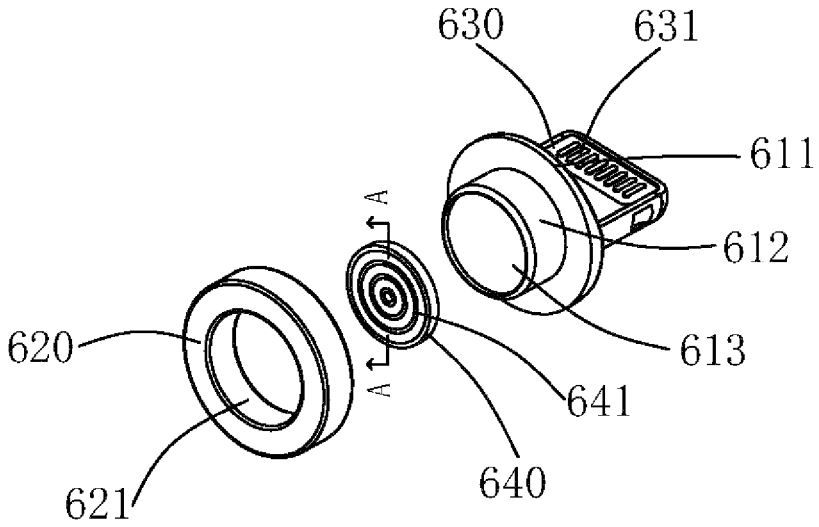
FIG. 3 is an exploded diagram of a first embodiment of the adaptor shown in FIG. 1.
Figure 4:
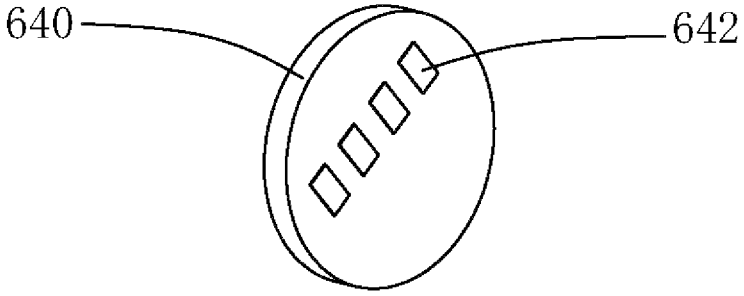
FIG. 4 is a schematic structural diagram of an embodiment of the adaptor plate shown in FIG. 3.
Figure 5:
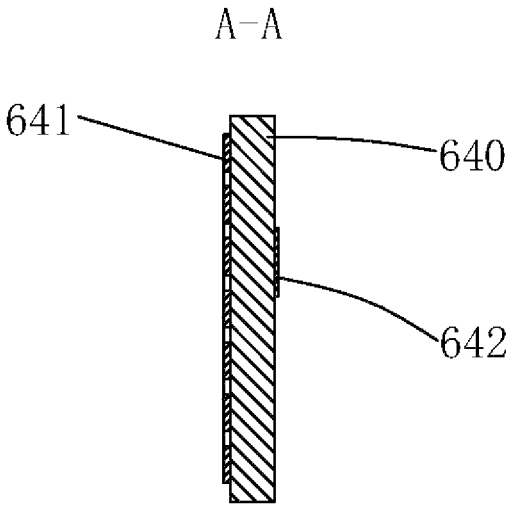
FIG. 5 is a cross-sectional view of an adaptor plate shown in FIG. 3 in the A-A direction.

Referring to FIG. 3 to FIG. 5, specifically, the adaptor 600 includes a male adaptor support 610, a male-end magnet 620, an adaptor joint 630, an adaptor plate 640 and a conductive ring 641. The male adaptor support 610 includes a blocking portion 611, a convex column 612 protruding from a side of the blocking portion 611, and a groove 613 formed at an end of the convex column 612 and away from the blocking portion 611. The blocking portion 611 is substantially in a circular thin-plate shape, the convex column 612 is substantially cylindrical, the blocking portion 611 is coaxially with the convex column 612, and an outer diameter of the blocking portion 611 is larger than an outer diameter of the convex column 612.

The adaptor plate 640 is substantially disc-shaped, with a plurality of conductive rings 641 and a plurality of conductive contacts 642 provided separately on two ends of the adaptor plate 640, and each conductive ring 641 is electrically connected with a corresponding conductive contact 642. The quantity of conductive rings 641 matches the quantity of the conductive contacts 642 matches, and the quantity of the conductive rings 641 and that of the conductive contacts 642 can be correspondingly adjusted according to actual use requirements. The end of the adaptor plate 640 provided with the conductive contact 642, is arranged in the groove 613, and the adaptor joint 630 is configured at an end of the blocking portion 611 and away from the convex column 612, in which case, the groove 613 functions for installation positioning. The adaptor joint 630 is provided with a plurality of conductive terminals 631, and the plurality of conductive terminals 631 are electrically connected to the plurality of conductive contacts 642, so as to get electrically connected to the plurality of conductive rings 641.

The male-end magnet 620 is substantially ring-shaped, and is provided with a through hole 621. The male-end magnet 620 is sleeved on the convex column 612 of the male adaptor support 610 through the through hole 621 and abuts against the blocking portion 611. An end surface of the adaptor 640 and provided with the conductive ring 640, protrudes out of the end surface of the male-end magnet 620, with a protruding length ranging from 0.5 millimeters to 5 millimeters. Typically, the protruding length may be 1.5 millimeters.

In this embodiment, typically, the adaptor 630 is a lightning connector. The adaptor plate 640, the male adaptor support 610 and the adaptor joint 630 are integrally formed through injection molding. The adaptor plate 640 is a circuit board. The conductive ring 641 and the conductive contact 642 are separately arranged on two opposite surfaces of the adaptor plate 640. The conductive ring 641 may be a conductive metal that is substantially circular, and a plurality of conductive rings 641 with different radiuses are concentrically distributed on the adaptor plate 640.

Figure 6:
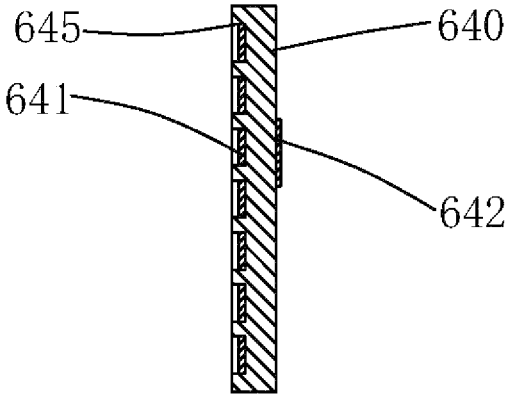
FIG. 6 is a schematic structural diagram of an adaptor plate in another embodiment.

As shown in FIG. 6, in another embodiment of the adaptor plate 640, a plurality of conductive contacts 642 are arranged on one end surface of the adaptor plate 640, while a plurality of annular sliding chutes 645 are concentrically formed on the other end surface. The plurality of conductive rings 641 are respectively arranged on inner walls, namely the inner bottom wall and/or the inner side wall, of the plurality of sliding chutes 645, and the plurality of conductive rings 641 are electrically connected with the plurality of conductive contacts 642 respectively. When the conductive ring 641 on the adaptor plate 640 electrically contact with a rotary contact portion 354 of a conductive element 350, the rotary contact portion 354 is inserted into the sliding chute 645, the inner side wall of the sliding chute 645 functions for limiting position protection for the rotary contact portion 354, to prevent the rotary contact portion 354 from deviating during the rotation process, so that the service life of the product can be prolonged.

Figure 7:
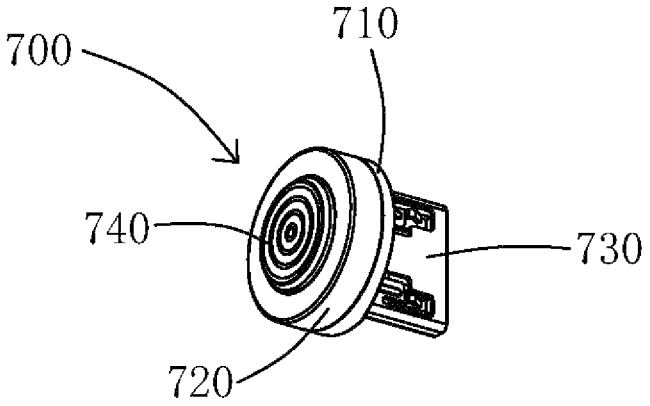
FIG. 7 is a schematic structural diagram of the adaptor in a second embodiment.

As shown in FIG. 7, in a second embodiment of the adaptor 700, the adaptor includes a male adaptor support 710, a male-end magnet 720, an adaptor joint 730 and an adaptor plate 740, the adaptor 730 is a micro USB connector, and is configured at one side of the male adaptor support 710, while the male-end magnet 720 and the adaptor plate 740 are configured on the other side of the male adaptor support 710.

Figure 8:
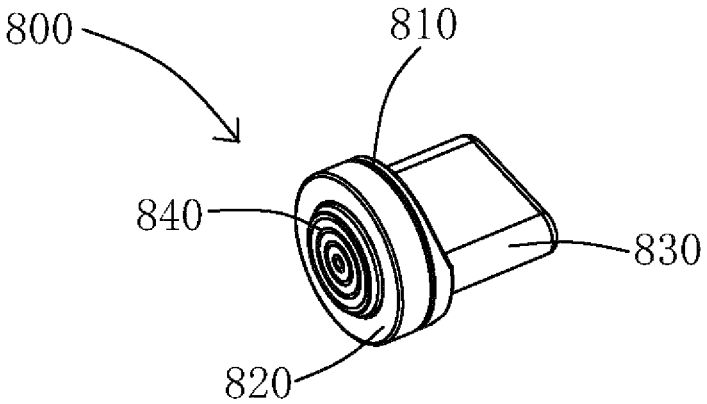
FIG. 8 is a schematic structural diagram of the adaptor in a third embodiment.
Figure 9:
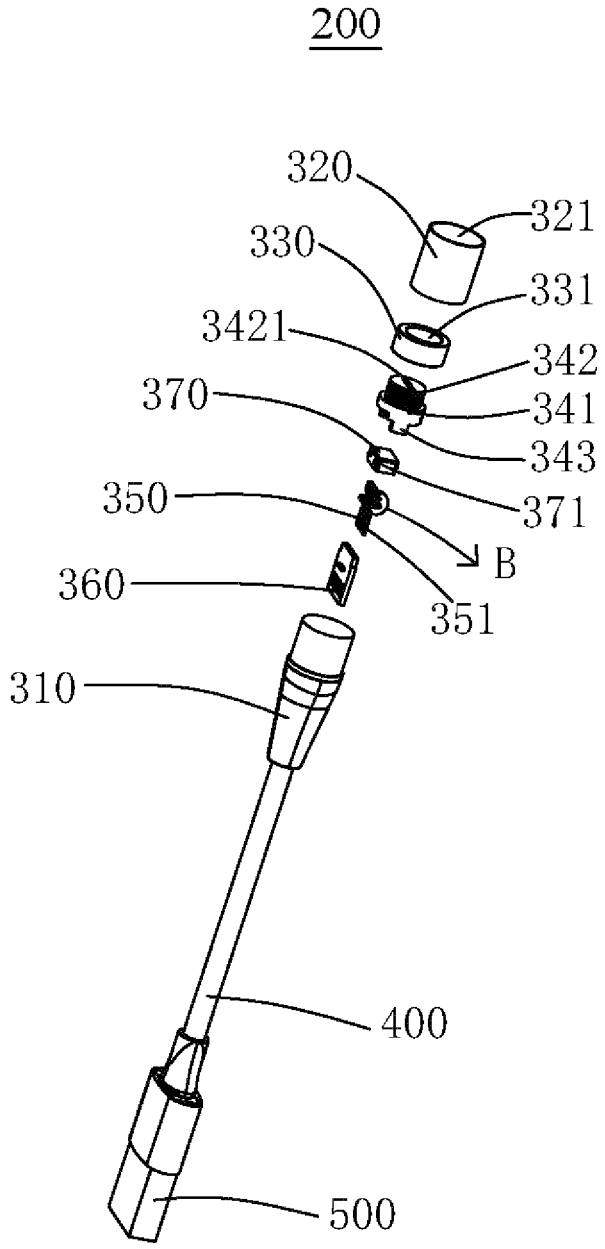
FIG. 9 is an exploded diagram of the first embodiment of a connector shown in FIG. 1.
Figure 10:
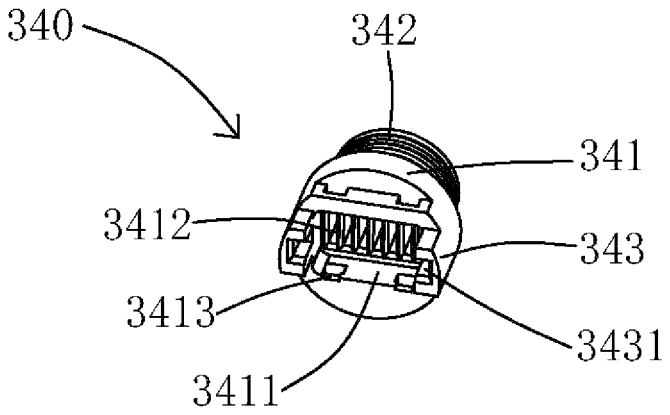
FIG. 10 is a structural schematic diagram of a female adaptor support shown in FIG. 9.
Figure 11:
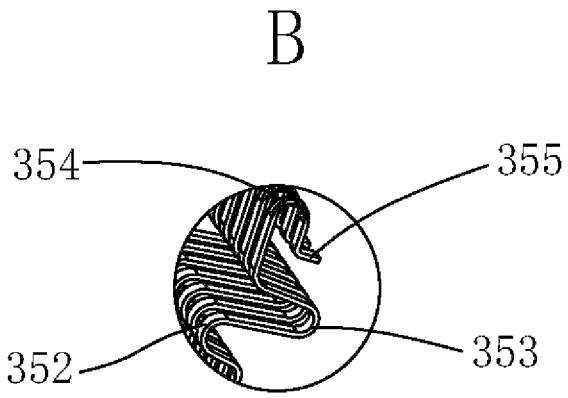
FIG. 11 is a partial enlarged view of the part B of the connector shown in FIG. 9.
Figure 12:
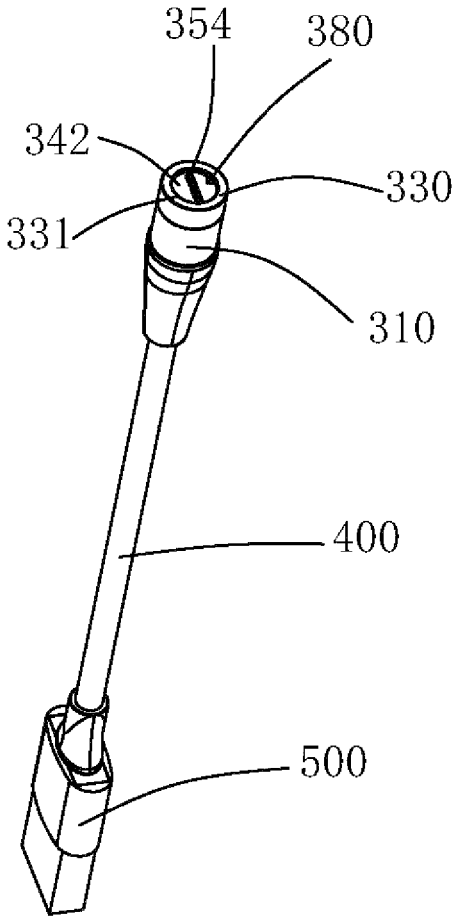
FIG. 12 is a schematic structural diagram of the connector shown in FIG. 9 after assembly, with the shell removed.

As shown in FIG. 8, in a third embodiment of the adaptor 800, the adaptor 800 includes a male adaptor support 810, a male-end magnet 820, an adaptor 830 and an adaptor plate 840. The adaptor 840 is a type-c connector, and is configured on one side of the male adaptor support 810, while the male-end magnet 820 and the adaptor plate 840 are arranged on the other side of the male adaptor support 810.

Referring to FIG. 1 to FIG. 2 and FIG. 9 to FIG. 12, as shown in these figures, the connecting body 300 of the connector 200 includes a base 310, a shell 320, a female-end magnet 330, a female adaptor support 340, the conductive element 350, a circuit board 360 and a clamping block 370. The base 310 is substantially conical, and the shell 320 is cylindrical and provided with a through hole 321. The female-end magnet 330 is in a circular ring shape and is provided with a sleeve connection hole 331.

The female adaptor support 340 includes a support body 341, and a fixing column 342 and a fixing block 343 which are separately configured on two sides of the support body 341. The support body 341 and the fixing column 342 are both substantially cylindrical, with an outer diameter of the support body 341 larger than an outer diameter of the fixing column 342. Two fixing blocks 343 both protrude out of one side of the support body 341. The end with the fixing block 343, of the support body 341, is provided with an installation cavity 3411 and a plurality of installation slots 3412. The installation slots 3412 are communicated with the installation cavity 3411 and extend to the fixing column 342. The installation cavity 3411 has an inner wall further provided with a plurality of clamping holes 3413. The end surface of the fixing columns 342 is provided with a plurality of through holes 3421 communicating with the installation cavity 3411 respectively, and the size of the through hole 3421 is smaller than that of the mounting groove 3412. A plurality of annular groove structures are formed at intervals on an outer side of the fixing column 342, and a slot 3431 is formed on the fixing block 343.

The conductive element 350 includes a fixing portion 351, a first bending portion 352, a second bending portion 353, the rotary contact portion 354 and an abutting portion 355, which are connected in sequence. The clamping block 370 are substantially in a square block shape, a plurality of protrusions 371 are formed on the outer side of the circuit board 360, and the fixing portions 351 of the plurality of conductive elements 350 are fixedly connected with the clamping block 370 and are electrically connected with the circuit board 360.

During installation, the rotary contact portion 354 of the plurality of conductive elements 350 is inserted into the installation slot 3412 of the female adaptor support 340, the first bent portion 352 and the second bent portion 353 separately slide along the upper and lower walls of the installation slot 3412, until the rotary contact portion 354 penetrates out of the through hole 3421, the abutting portion 355 abuts against the inner wall of the installation slot 3412 and further insertion cannot be continued. In the installation process of the rotary contact portion 354, two sides of the circuit board 360 are inserted into the slot 3431, the clamping block 370 is inserted into the installation cavity 3411, and the protrusions 371 of the clamping block 370 are clamped into the clamping holes 3413, so that the clamping block 370 and the plurality of conductive elements 350 are fixed on the female adaptor support 340, to achieve a steady structure.

The base 310 is plastic, while the circuit board 360, the clamping block 370, and one end of the female adaptor support 340 are integrally formed with the base 310 through injection molding. The female-end magnet 330 sleeves the fixing column 342 of the female adaptor support 340 through the sleeve connection hole 331, with the inner wall of the sleeve connection hole 331 connected with the end surface of the fixing column 342 to form a positioning cavity 380, and the rotary contact portion 354 of the conductive element 350 is located in the positioning cavity 380. Since the end surface provided with the conductive ring 641 protrudes out of the end surface of the male-end magnet 620, when the protruding part is embedded into the positioning cavity 360, the limiting position function can be achieved, so as to prevent sideslip displacement between the adaptor 600 and the connector 200. Since a plurality of annular groove structures are configured at intervals on the outer side of the fixing column 342, the installation of the female-end magnet 330 is steady. The through hole 321 of the shell 320 is sleeved on the fixing column 342 of the female adaptor support 340 and the female-end magnet 330, so that the female adaptor support 340 and the female-end magnet 330 can be surrounded.

During operation, the adaptor plate 640 of the adaptor 600 is inserted into the positioning cavity 380 of the connector 200, the male-end magnet 620 and the female-end magnet 330 attract each other, the adaptor 600 and the connector 200 abut against each other and are fixed together, so that the adaptor 600 can be rotatably connected to the connector 200, and the conductive ring 641 on the adaptor plate 640 is in electrical contact with the rotary contact portion 354 of the conductive element 350. When the adaptor 600 and the connector 200 rotate relative to each other, the conductive ring 641 keeps electrically connected with the rotary contact portion 354.

Figure 13:
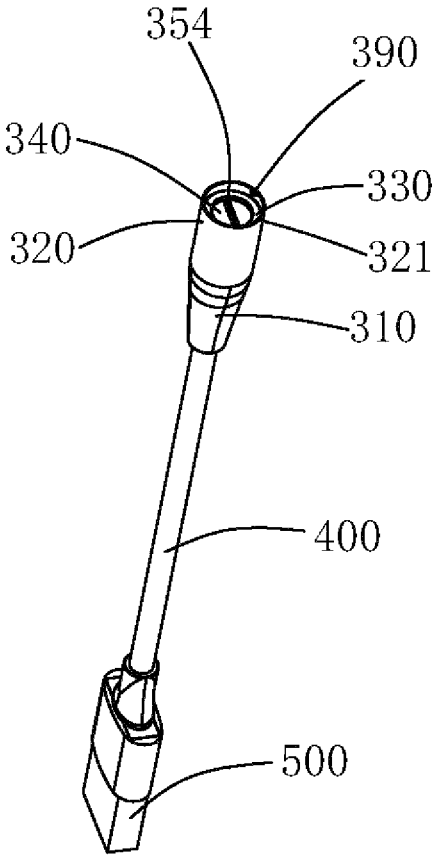
FIG. 13 is a schematic structural diagram of a connector in a second embodiment.

Referring to FIG. 13, in another embodiment of the connector 200, the shell 320 sleeves the female adaptor support 340, and forms an accommodation cavity 390 with the female adaptor support 340. The male adaptor support 610 of the adaptor 600 can be inserted into the accommodation cavity 370, to electrically connect the conductive ring 641 with the rotary contact portion 354 of the conductive element 350, so that the adaptor 600 can be rotatably and electrically connected to the connector 200.

Further, the female-end magnet 330 is sleeved on the female adaptor support 340 and is positioned in the accommodation cavity 370, and when the male adaptor support 610 and the male-end magnet 620 of the adaptor 300 are inserted into the accommodation cavity 390, and the female-end magnet 330 and the male-end magnet 620 attract each other to tightly attach to each other, the male-end magnet 620 may rotate under the position limitation of the inner wall of the accommodation cavity 370 (namely, the inner wall of the outer shell) so as to effectively prevent sideslip displacement between the adaptor 600 and the connector 200.

The above embodiments are merely intended to illustrate the technical solutions of the present disclosure and are not limited thereto. Although the present disclosure is described in detail with reference to the foregoing embodiments, those of ordinary skills in the art should understand that the technical solution described in the embodiments can also be modified, or the technical features in the technical solutions can be equivalently replaced, and the modification or replacement will not separate the essence of the corresponding technical solution from the spirit and scope of the technical solution of the present disclosure. The above descriptions are merely some embodiments of the present disclosure, it should be noted that, for a one with ordinary skill in the art, without departing from the concept of the present disclosure, modifications may also be made, but these all belong to the protection scope of the present disclosure.

What is claimed is:

1. An adaptor, comprising:

a male adaptor support;

an adaptor plate, which is arranged on the male adaptor support;

a plurality of conductive rings, which is arranged on the adaptor plate, the conductive rings spaced from each other and arranged as concentric circles with different diameters; and an adaptor joint, the adaptor joint and the adaptor plate are separately arranged at two ends of the male adaptor support, the conductive ring electrically connected with the adaptor joint;

wherein, the adaptor further comprises a male-end magnet, and the male-end magnet is arranged on the male adaptor support; and the male adaptor support is provided with a convex column, the adaptor plate is arranged at an end of the convex column, and the male-end magnet is sleeved on the convex column, with an end of the adaptor plate, away from the convex column, protruding out of an end surface of the male-end magnet.

2. The adaptor of claim 1, wherein the male-end magnet is ring-shaped.

3. The adaptor of claim 1, wherein a groove is formed at the end of the convex column, and the adaptor plate is arranged in the groove.

4. The adaptor of claim 1, wherein one side of the adaptor plate is provided with a sliding chute, with the conductive ring arranged on an inner wall of the sliding chute.

5. The adaptor of claim 1, wherein the adaptor is any one of a micro USB connector, a type-c connector or a lightning connector.

6. A connector assembly, comprising:

the adaptor in claim 1; and a connector, comprising a female adaptor support and a conductive element arranged on the female adaptor support, the conductive element provided with a rotary contact portion, and the rotary contact portion protruding out of an end surface of the female adaptor support;

when the adaptor and the connector are in contact and rotate relative to each other, the rotary contact portion keeping electrically connected with the conducting ring.

7. The connector assembly of claim 6, wherein, the connector assembly further comprises a female-end magnet, and the female-end magnet is provided with a sleeve connection hole, the sleeve connection hole is sleeved on the female adaptor support and forms a positioning cavity, and the adaptor plate is inserted into the positioning cavity to rotatably connect the adaptor with the connector.

8. The connector assembly of claim 6, wherein, the connector assembly further comprises a clamping block, an installation cavity is formed at one end of the female adaptor support, and a through hole formed at the other end of the female adaptor support communicates with the installation cavity; one end of the conductive element is fixed to the clamping block, and the other end of the conductive element penetrates through the installation cavity and penetrates out of the through hole; the clamping block is clamped with the installation cavity to fix the conductive element in the female adaptor support.

9. The connector assembly of claim 8, wherein, the connector assembly further comprises a base, a circuit board and a shell, the female adaptor support is provided with a slot, the circuit board is inserted into the slot and electrically connected with the conductive element; the circuit board, the clamping block and one end of the female adaptor support are integrally formed with the base through injection molding, and the shell is sleeved on the other end of the female adaptor support to surround the female adaptor support and the female-end magnet.

10. The connector assembly of claim 9, wherein, the connector assembly further comprises a wire and a plug, the wire connects the plug with the base, and the plug is electrically connected with the circuit board.

11. A connector assembly, comprises:

the adaptor in claim 1; and a connector comprises a female adaptor support, a conductive element and a shell, wherein the conductive element is arranged on the female adaptor support, and the shell is sleeved on the female adaptor support, the conductive element is provided with a rotary contact portion, and the rotary contact portion protrudes out of an end surface of the female adaptor support; wherein the shell and the female adaptor support form an accommodation cavity, the male adaptor support is inserted into the accommodation cavity to electrically connect the conductive ring with the rotary contact portion, to rotatably connect the adaptor with the connector.

12. The connector assembly of claim 11, wherein, the connector assembly further comprises a female-end magnet, and the female-end magnet is sleeved on the female adaptor support and is located in the accommodation cavity.

* * * * *